US006636191B2

(12) United States Patent
Cok

(10) Patent No.: US 6,636,191 B2
(45) **Date of Patent: *Oct. 21, 2003**

(54) EMISSIVE DISPLAY WITH IMPROVED PERSISTENCE

(75) Inventor: Ronald S. Cok, Rochester, NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/510,759

(22) Filed: Feb. 22, 2000

(65) Prior Publication Data

US 2002/0186188 A1 Dec. 12, 2002

(51) Int. Cl.[7] ..... G09G 3/32

(52) U.S. Cl. ..... 345/82; 345/42; 345/44; 345/46

(58) Field of Search ..... 345/82, 84, 44, 345/46

(56) References Cited

U.S. PATENT DOCUMENTS

| | | | | |
|---|---|---|---|---|
| 3,696,393 A | * | 10/1972 | McDonald | 345/82 |
| 4,769,292 A | | 9/1988 | Tang et al. | |
| 4,802,123 A | * | 1/1989 | Tobita | 365/149 |
| 5,061,569 A | | 10/1991 | VanSlyke et al. | |
| 5,138,186 A | * | 8/1992 | Dumbovic | 327/91 |
| 5,198,803 A | * | 3/1993 | Shie et al. | 345/82 |
| 5,552,678 A | | 9/1996 | Tang et al. | |
| 5,952,789 A | * | 9/1999 | Stewart et al. | 315/169.4 |
| 5,953,061 A | | 9/1999 | Biegelsen et al. | |
| 6,190,933 B1 | * | 2/2001 | Shimabukuro et al. | 438/30 |
| 6,229,506 B1 | * | 5/2001 | Dawson et al. | 345/82 |
| 6,307,528 B1 | * | 10/2001 | Yap | 345/45 |
| 6,392,617 B1 | * | 5/2002 | Gleason | 345/82 |

FOREIGN PATENT DOCUMENTS

| | | | |
|---|---|---|---|
| EP | 0 905 673 A1 | 3/1999 | |
| EP | 1005013 A | * 11/1999 | G09G/3/32 |

OTHER PUBLICATIONS

Dawson et al., "A Polysilicon Active Matrix Organic Light Emitting Diode Display with Integrated Drivers", *Society for Information Display Digest,* 1988, pp. 11–14.

* cited by examiner

*Primary Examiner*—Steven Saras
*Assistant Examiner*—Fritz Alphonse
(74) *Attorney, Agent, or Firm*—Thomas H. Close

(57) ABSTRACT

A persistent emissive display device, includes: a light emitting element; a drive circuit connected to the light emitting element, the drive circuit including a transistor having a gate for controlling the power applied to the light emitting element; a storage capacitor connected to the gate of the drive circuit transistor; a control circuit for depositing charge to the storage capacitor; and a circuit element for reducing charge leakage from the storage capacitor, whereby attributes of the display including the persistence of the display, switching speed, and power can be optimized for a given application.

8 Claims, 3 Drawing Sheets

EMISSIVE DISPLAY WITH IMPROVED PERSISTENCE

FIELD OF THE INVENTION

The present invention relates to solid-state display devices and means to store and display pixel values and images.

BACKGROUND OF THE INVENTION

Solid-state displays can be characterized as emissive or non-emissive. An emissive display directly generates light at each pixel and requires power to operate and display information. Liquid crystal displays (LCDs), in contrast, are non-emissive and maintain their state without drawing significant current. (LCDs are non-volatile although power is needed to make their state visible either through backlighting or ambient light, or to change their state. The switched state is maintained through an applied electrostatic field.) The liquid crystals themselves do not emit light but rather change the polarization of light passing through them. LCDs are thus non-emissive and generally utilize a backlight to make their display visible. A non-volatile display is, by definition, persistent.

Solid state image display devices utilizing light emissive pixels are well known and widely used. Much work has been done to improve the brightness, uniformity, contrast, etc. of the displays so as to make them as pleasing as possible. For example, European Patent Application EP 0 905 673 A1, by Kane et al., published Mar. 31, 1999, entitled "Active Matrix Display System and a Method for Driving the Same" and the article entitled "A Polysilicon Active Matrix Organic Light Emitting Diode Display with Integrated Drivers" by Dawson et al., published in the Society for Information Display Digest, 1998, pages 11–14, describe such efforts. Generally speaking, these devices require power to maintain their information state (they are volatile), and because of charge leakage, can only maintain and display an image for a limited amount of time after which it begins to fade (they are not persistent). The image is then refreshed, that is the image is rewritten into the display device. Refresh circuitry can be complex, require high data rates, and impose a significant financial, power, and size burden on a system. In particular, refreshing a display requires a significant use of system power. The frequency with which the display must be rewritten depends on the persistence of the display (how long it can maintain an acceptable image) and the rate at which the image content changes. If the image content changes more frequently than the rate at which the image fades, there will never be a problem. This is generally the case in video-rate systems. However, in cases where the content changes slowly or where only portions of an image change, a periodic display refresh may be unnecessary for a persistent display. Hence, persistence can be a useful attribute in a display and reduces the system cost and power consumption. For example, a persistent emissive display designed for still images alone may not require periodic refresh capability.

One mechanism used to create non-volatile displays is to integrate non-volatile memory elements directly within the display device. For example, U.S. Pat. No. 5,953,061 issued Sep. 14, 1999 to Biegelsen et al., entitled "Pixel Cells Having Integrated Analog Memories and Arrays Thereof" describes such a system based on ferro-electric memory designs. This approach, while viable, requires considerable supporting electronic elements to implement and frequently relies on problematic materials and manufacturing processes.

Solid-state image displays are typically organized by address and data controls representing the value of each pixel in the display. The address is converted into a select line (or combination of select lines) controlling an individual pixel and a data line representing the analog value of the pixel. Each pixel is then managed by the Data and Select control lines and incorporates means to store a charge representing the value of the pixel at the pixel site, and a mechanism to emit light from the stored charge. The control mechanisms are generally implemented using transistors and the storage mechanisms through capacitors. U.S. Pat. No. 5,552,678 issued Sep. 3, 1996 to Tang et al., entitled "AC Drive Scheme for Organic LED" describes an AC drive scheme for use with organic LEDs.

FIG. 1 is a schematic block diagram of a typical prior art display pixel in an emissive display. The display element includes a control logic block 42, a charge storage block 44, and a display block 48.

FIG. 2 shows a circuit diagram implementing the block diagram of FIG. 1. for an LED display. In this figure, the pixel is formed on a substrate 10, and includes a control transistor Tc 12, (corresponding to the control logic block 42 in FIG. 1) that stores charge on a storage capacitor Cref 14 (corresponding to charge storage block 44) which is connected to the gate of a display transistor Td 20, which controls current to an LED 22 (corresponding to display block 48 in FIG. 1). The control transistor Tc 12 is responsive to signals applied to control lines (Select 16 and Data 18) and, when active, deposits a charge onto charge storage capacitor Cref 14. Cref 14 then controls the drive transistor Td 20, which controls current to the LED 22. Td 20 is optimized to effectively drive the LED 22; Tc 12 to charge the storage capacitor 14 and respond to the control lines 16 & 18. To perform these tasks, both transistors 12 & 20 tend to be large; Tc 12 to provide fast switching time and Td 20 to provide the maximum current (and brightness) through the LED 22.

The persistence of the display is directly related to the length of time that the storage capacitor 14 can maintain its charge. There are three basic mechanisms through which this charge can dissipate. The first is directly across the capacitor 24 (leakage) and will be affected by the materials and structures used to implement the capacitor in the circuit. Second, charge 26 is dissipated to drive the display transistor 20. Third, charge 28 can leak back through the control transistor 12. These leakage paths are illustrated with the curved arrows 26 and 28 in FIG. 2. Leakage through the capacitor 14 itself is exacerbated by material impurities; leakage back through control transistor Tc 12 is attributed to source-to-drain and source-to-gate leakage; and leakage through display transistor Td 20 by gate-to-source leakage. The leakage through the transistors is greater for larger transistors.

Generally, each display device uses electronic elements, transistors, capacitors, and the like that are optimized to the manufacturing process and the task to which the elements are put. The traditional arrangement and size of storage and emitter drivers decreases the persistence of the display. This, in turn, imposes system costs on any practical imaging system by forcing periodic refresh requirements. These system costs can include design effort, manufacturing costs, complexity, performance, reduced system reliability, and power. There is a need therefore for an improved persistent emissive display that is less costly to manufacture, has a simpler design and exhibits improved performance over the prior art devices.

SUMMARY OF THE INVENTION

The above noted need is met according to the present invention by providing a persistent emissive display device, including: a light emitting element; a drive circuit connected to the light emitting element, the drive circuit including a transistor having a gate for controlling the power applied to the light emitting element; a storage capacitor connected to the gate of the drive circuit transistor; a control circuit for depositing charge on the storage capacitor; and a circuit element for reducing charge leakage from the storage capacitor, whereby attributes of the display including the persistence of the display, switching speed, and power can be optimized for a given application.

ADVANTAGES

The advantages of this invention are that it provides a digital, solid-state emissive display device with persistence and reduced refresh costs. Each pixel site can be optimized for effective, persistent data storage, for charging, and for effective control and power for the light-emitting component. A display system using this invention may also have reduced power needs for low data-rate imaging such as a still picture display.

DETAILED DESCRIPTION OF THE INVENTION

The foregoing problems relating to the persistent display of digital images in a solid-state device are addressed according to the present invention by integrating isolating circuit elements between the storage capacitor and the drive circuit and/or control circuit for each pixel in the display.

Figure 1:
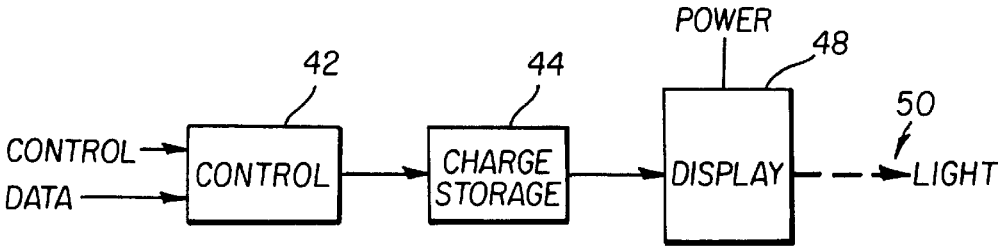
FIG. 1 (Prior Art)
FIG. 1 is a schematic block diagram showing a pixel employed in a prior art solid-state emissive display.
Figure 2:
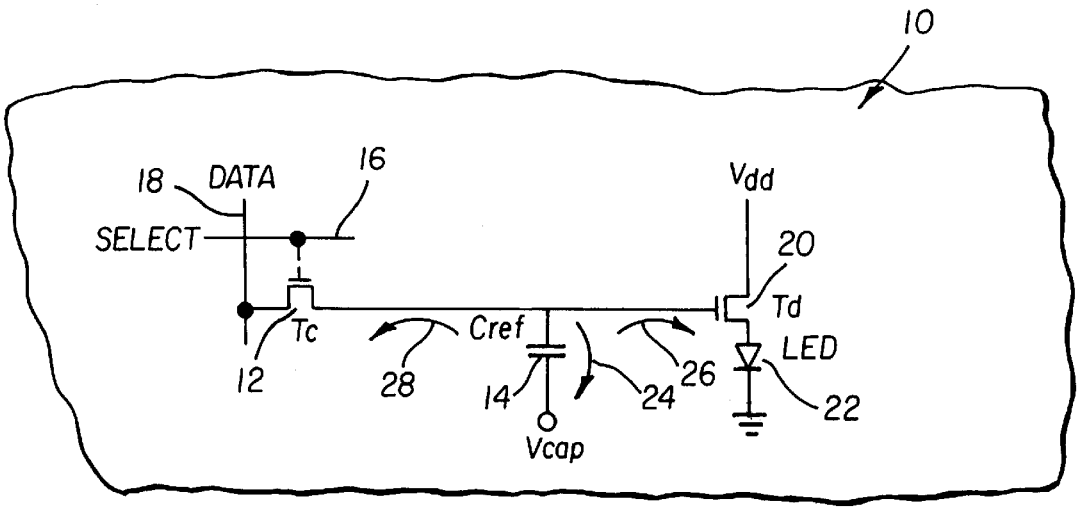
FIG. 2 (Prior Art)
FIG. 2 is a circuit diagram implementing the prior art pixel shown in the block diagram of FIG. 1.
Figure 3:
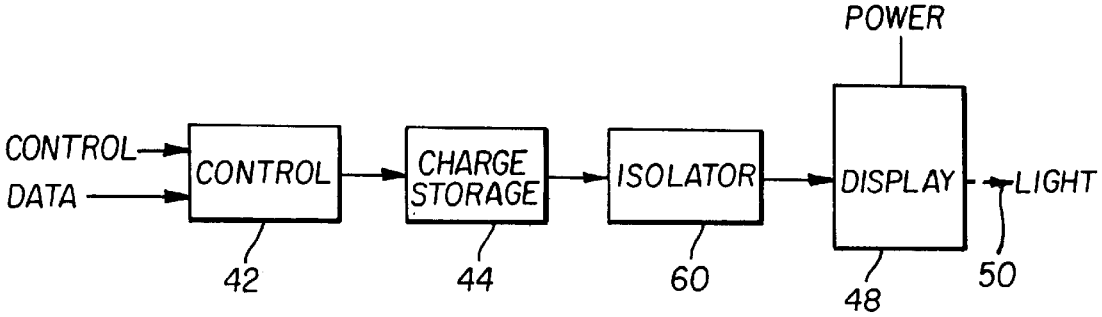
FIGS. 3–5 are block diagrams showing alternative arrangements of the use of circuit elements to isolate a charge storage element in an emissive display according to the present invention.
Figure 4:
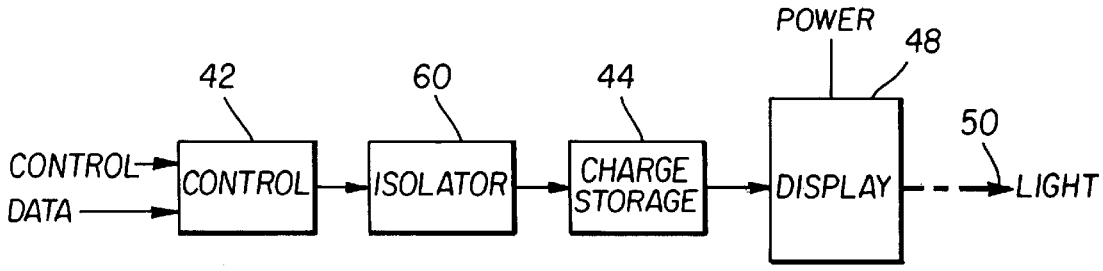
Figure 5:
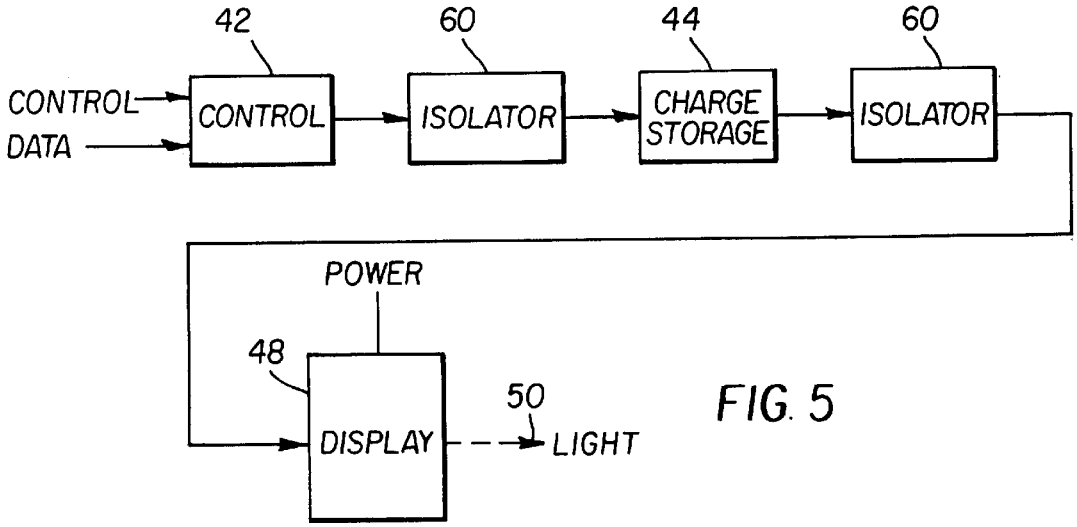

FIGS. 3–5 show schematic block diagrams of various arrangements of the present invention. In these figures we see four different blocks, a control block 42; a charge storage block 44; a display block 48 and an isolator block 60. The control block 42 receives control signals and data signals generated using conventional means. The control block 42 (corresponding to transistor 12 in FIG. 2) stores the relevant analog pixel information in charge storage block 44 (corresponding to storage capacitor 14 in FIG. 2). The display block 48 (corresponding to transistor 20 and LED 22 in FIG. 2) receives information from the charge storage block 44 and produces light 50. The fourth block 60 according to the present invention includes a circuit element for reducing charge leakage from the storage block 44. The circuit element in isolator block 60 is, for example a very small, high-impedance field effect transistor, optimized for minimal power consumption and charge leakage. Referring to FIG. 3 the charge storage block 44 is isolated from the display 48 by isolator block 60. In FIG. 4 the charge storage block 44 is isolated from the control block 42; and in FIG. 5 the charge storage block 44 is isolated from both the control block 42 and the display block 48.

Figure 6:
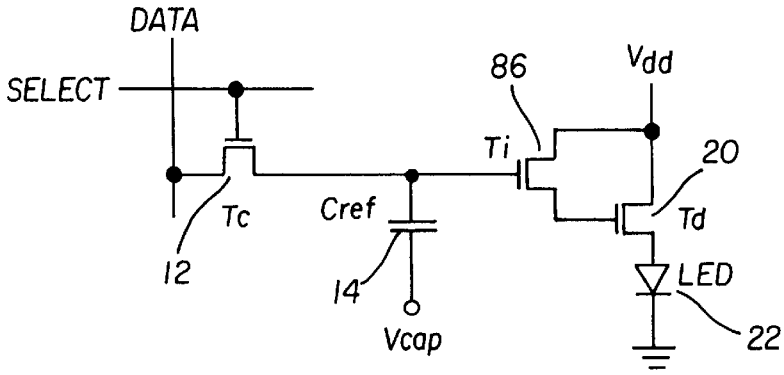
FIGS. 6–7 are circuit diagrams showing alternative circuit implementations of the arrangements of the present invention shown in FIG. 3.

These generic concepts can be realized in a number of ways to produce an emissive display pixel exhibiting improved persistence. FIGS. 6–9 illustrate circuit implementations for the alternative arrangements shown in FIGS. 3–5. Referring to FIG. 6, an embodiment corresponding to FIG. 3 is shown. Control Transistor Tc 12 deposits a charge on storage capacitor Cref 14. According to the present invention, a very small (relative to drive transistor Td 20) high-impedance transistor, Ti 86, isolates the storage capacitor Cref 14 from the drive transistor 20. When Cref 14 is charged, it turns Ti 86 on. Ti 86 in turn drives Td 20 which powers the LED 22. Because Ti 86 is much smaller than Td 20 and thus has less leakage, the circuit exhibits improved persistence without decreasing the LED brightness.

Figure 7:
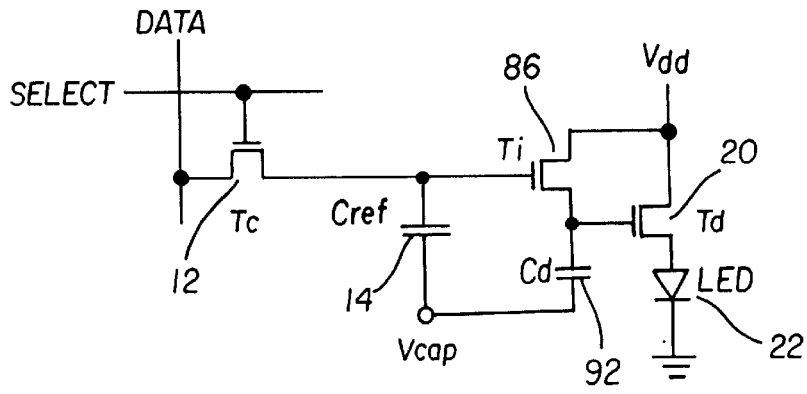

Referring to FIG. 7, the use of a second capacitor Cd 92 has the added benefit of optimizing the circuit for characteristics other than persistent storage times. For example, the capacitor Cd 92 smoothes the display transition from one pixel state (value) to another, acting as a low-pass temporal filter. The isolating transistor Ti 86 allows the system designed to individually optimize the components for desired attributes.

Figure 8:
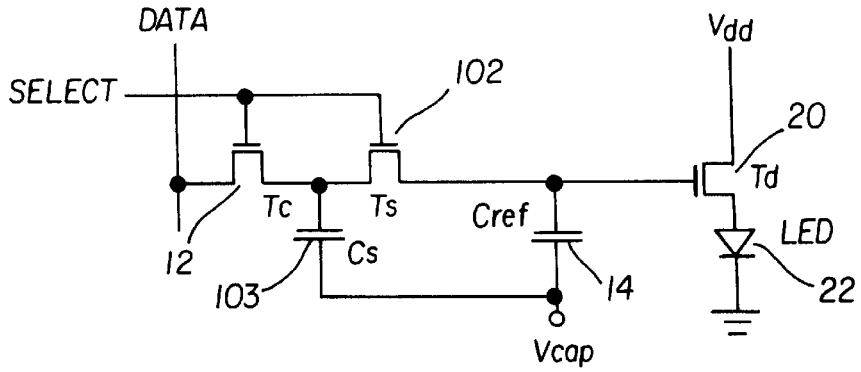
FIG. 8 is a circuit diagram showing a circuit implementation of the arrangement of the present invention shown in FIG. 4.
Figure 9:
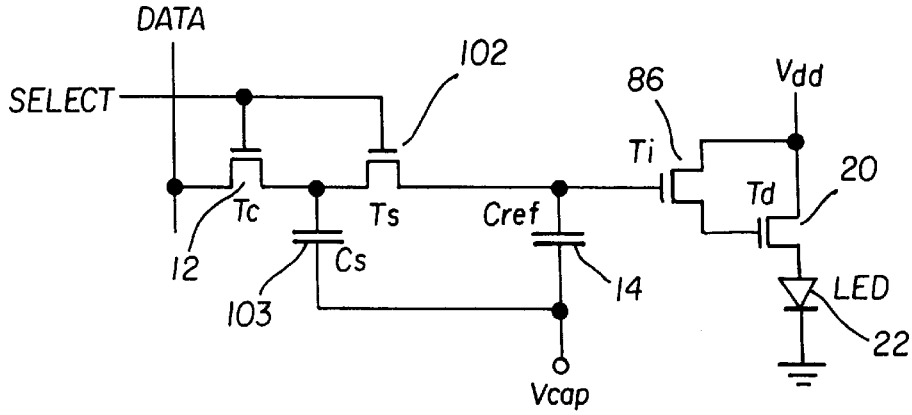
FIG. 9 is a circuit diagram showing a circuit implementation of the arrangement of the present invention shown in FIG. 5.

Referring to FIG. 8, which implements the alternative arrangement shown in FIG. 4, a transistor Ts 102 and capacitor Cs 103 are added between the control transistor 12 and the storage capacitor 14. The capacitor Cs 103 stores the control signal while it is being transferred to capacitor Cref 14 via Transistor Ts 102. The transistor Ts 102 is made much smaller than Tc 12 to reduce the leakage through the control mechanism. Referring to FIG. 9 (which implements the arrangement shown in FIG. 5), a small isolating transistor Ts 102 and a small isolating transistor Ti 114 within a circuit are arranged on either side of storage capacitor Cref 14.

Not only does the use of intervening isolating circuit elements according to the present invention enable longer storage times, it also enables the separate optimization of each component. The storage capacitor 14, for example, can be designed for quick charging without regard for charge draining, thus making the select and data control lines easier to manage. Likewise, the drive transistor 20 for the light emitter 22 can be efficiently optimized without regard to draining current from the charge storage capacitor 14. Most importantly, the isolating circuit element can be optimized to reduce the energy drain on the storage capacitor, thus enabling persistent display.

Although the employment of additional components uses more space on the display device, this is not a critical concern for top-or bottom-emitting devices such as OLEDs, since the additional components can be placed below or above the display materials. Moreover, depending on the characteristics of the materials, the addition of isolating circuit elements according to the present invention also enable the use of smaller storage capacitors. Since the storage capacitors are a significant fraction of the overall surface area of a display, a reduction in their size, even at the cost of additional, small transistors, may result in a greater percentage of the display area dedicated to the display materials.

Generally, a system with increased persistence that supports reduced refresh is most useful when image content changes slowly or incompletely. Note that the increased isolation mechanisms described here can be implemented with smaller and slower transistors. Since the image content is likely to change more slowly in these applications, the potential loss of switching speed need not be critical. Displays may even be customized so that some portions of the display exhibit increased persistence, reducing the need for refreshing in those areas that are unlikely to change frequently (such as icons).

In a preferred embodiment, the invention is employed in an emissive display that includes Organic Light Emitting Diodes (OLEDs) which are composed of small molecule polymeric OLEDs as disclosed in but not limited to U.S. Pat. No. 4,769,292, issued Sep. 6, 1988 to Tang et al., entitled "Electroluminescent Device with Modified Thin Film Luminescent Zone" and U.S. Pat. No. 5,061,569, issued Oct. 29, 1991 to VanSlyke et al., entitled "Electroluminescent Device with Organic Electroluminescent Medium" provide a technical platform on which an integrated imaging platform can be constructed. Many combinations and variations of OLED can be used to fabricate such a device. OLED devices can be integrated in a micro-circuit on a conventional silicon substrate 10 and exhibit the necessary characteristics. Alternatively, OLED devices may also be integrated upon other substrates, such as glass having a pattern of conductive oxide and amorphous, polycrystalline, or continuous grain silicon material deposited thereon. The deposited silicon materials may be single-crystal in nature or be amorphous, polycrystalline, or continuous grain. These deposited materials and substrates are known in the prior art and this invention, and may be applied equally to any micro-circuit integrated on a suitable substrate.

The invention has been described in detail with particular reference to certain preferred embodiments thereof, but it will be understood that variations and modifications can be effected within the spirit and scope of the invention.

Parts List

| PARTS LIST | |
|---|---|
| 10 | pixel |
| 12 | transistor |
| 14 | capacitor |
| 16 | control line |
| 18 | control line |
| 20 | transistor |
| 22 | LED display component |
| 24 | leakage path |
| 26 | leakage path |
| 28 | leakage path |
| 40 | generic pixel |
| 42 | component |
| 44 | storage device |
| 48 | display mechanism |
| 50 | light |
| 60 | isolation device |
| 86 | transistor |
| 92 | capacitor |
| 102 | transistor |
| 103 | capacitor |

What is claimed is:

1. A persistent emissive display device, comprising:

a) a light emitting element;

b) a drive circuit connected to the light emitting element, the drive circuit including a transistor having a gate for controlling the power applied to the light emitting element;

c) a storage capacitor connected to the gate of the drive circuit transistor;

d) a control circuit comprising a field effect transistor having a characteristic leakage for depositing charge to the storage capacitor; and e) a high-impedance field effect transistor having lower leakage, located between the control circuit and the storage capacitor for reducing charge leakage from the storage capacitor, whereby attributes of the display including the persistence of the display, switching speed, and power can be optimized for a given application.

2. The display device claimed in claim 1, wherein the light emitting element is an organic LED.

3. The display device claimed in claim 2 wherein the organic LED is deposited on a single-crystal Silicon substrate.

4. The display device claimed in claim 2 wherein the organic LED is deposited on a glass substrate having a pattern of conductive oxide and amorphous, polycrystalline, or continuous grain silicon material.

5. A persistent emissive display device, comprising:

a) a light emitting element;

b) a drive circuit connected to the light emitting element, the drive circuit including a field effect transistor having a characteristic leakage and a gate for controlling the power applied to the light emitting element;

c) a storage capacitor connected to the gate of the drive circuit transistor;

d) a control circuit comprising a field effect transistor for depositing charge to the storage capacitor, the field effect transistor having a characteristic leakage; and e) a first high-impedance field effect transistor having lower leakage than the drive circuit located between the drive circuit and the storage capacitor, and a second high impedance field effect transistor having lower leakage than the control circuit, located between the control circuit and the storage capacitor for reducing charge leakage from the storage capacitor, whereby attributes of the display including the persistence of the display, switching speed, and power can be optimized for a given application.

6. The display device claimed in claim 5, wherein the light emitting element is an organic LED.

7. The display device claimed in claim 6, wherein the organic LED is deposited on a single-crystal Silicon substrate.

8. The display device claimed in claim 6, wherein the organic LED is deposited on a glass substrate having a pattern of conductive oxide and amorphous, polycrystalline, or continuous grain silicon material.

* * * * *